United States Patent [19]

Caron et al.

[11] 4,073,667

[45] * Feb. 14, 1978

[54] PROCESSING FOR IMPROVED STRESS RELAXATION RESISTANCE IN COPPER ALLOYS EXHIBITING SPINODAL DECOMPOSITION

[75] Inventors: Ronald N. Caron, Branford; Stanley Shapiro, New Haven, both of Conn.

[73] Assignee: Olin Corporation, New Haven, Conn.

[ * ] Notice: The portion of the term of this patent subsequent to Apr. 5, 1994, has been disclaimed.

[21] Appl. No.: 743,121

[22] Filed: Nov. 19, 1976

Related U.S. Application Data

[63] Continuation-in-part of Ser. No. 655,791, Feb. 6, 1976, Pat. No. 4,016,010.

[51] Int. Cl.[2] ..... C22F 1/08

[52] U.S. Cl. ..... 148/12.7 C

[58] Field of Search ..... 148/11.5 C, 12.7 C; 75/164, 159, 153

[56] References Cited

U.S. PATENT DOCUMENTS

| | | | |
|---|---|---|---|
| 2,783,143 | 2/1957 | Johnson et al. | 75/164 |
| 2,943,960 | 7/1960 | Saanvirta | 75/164 |
| 3,258,334 | 6/1966 | Kessler | 75/159 |
| 3,663,311 | 5/1972 | Chin et al. | 148/11.5 C |
| 4,012,240 | 3/1977 | Hinrichsen et al. | 148/11.5 C |
| 4,016,010 | 4/1977 | Caron et al. | 148/12.7 C |

*Primary Examiner*—W. Stallard

*Attorney, Agent, or Firm*—Robert A. Dawson; Robert H. Bachman

[57] ABSTRACT

A process for providing copper base alloys with a combination of high strength and high strength to ductility characteristics is disclosed. The alloys should be those copper alloys which exhibit continuous, homogeneous precipitation of coherent particles such as spinodal decomposition upon precipitation hardening. The alloys are hot worked, solution annealed and subjected to a controlled cooling to provide the desirable strength-ductility combinations.

18 Claims, No Drawings

PROCESSING FOR IMPROVED STRESS RELAXATION RESISTANCE IN COPPER ALLOYS EXHIBITING SPINODAL DECOMPOSITION

CROSS REFERENCE TO RELATED APPLICATION

This application is a Continuation-In-Part of co-pending application Ser. No. 655,791 by Ronald N. Caron et al. for "Preparation of High Strength Copper-Base Alloy", filed Feb. 6, 1976, now U.S. Pat. No. 4,016,010.

BACKGROUND OF THE INVENTION

It is highly desirable to provide copper alloys exhibiting a combination of high strength and high strength to ductility characteristics. It is particularly desirable to provide relatively inexpensive hot and cold workable copper alloys which exhibit high mechanical strength, favorable strength to ductility ratios and excellent formability characteristics. These copper alloys which exhibit the properties outlined above should also be convenient to process and should be able to be produced economically on a commercial scale.

Such alloys exhibiting the characteristics presented hereinabove satisfy the stringent requirements imposed by modern applications for electrical contact springs, for example, in which high strength is required coupled with good bend formability as well as resistance to mechanical property degradation at moderately elevated temperatures. This resistance to degradation is generally known as stress relaxation resistance. Commercially known copper alloys tend to exhibit deficiencies in one or more of the desirable characteristics outlined above. For example, the commercial copper Alloy 510 (a phosphor-bronze containing from 3.5 to 5.8% tin and from 0.03 to 0.35% phosphorus) exhibits superior strength properties but poor bending properties. The commercial copper Alloy 725 (a copper-nickel containing 8.5 to 10.5% nickel and from 1.8 to 2.8% tin) exhibits superior bend properties along with good solderability and contact resistance but insufficient strength properties.

One family of alloys which is able to satisfy all of the requirements presented above are the copper alloys which exhibit their combinations of properties based upon arrays of continuous, coherent precipitates in a solute depleted copper matrix, such as Cu-Ti systems containing 0.5 to 4.7% by weight Ti, the Cu-Be family of alloys containing 0.2 to 2.7% by weight Be and the various coherent precipitation reactions that can be induced to form in the various cupro-nickel compositions through the additions of third and fourth alloying elements. One example of the latter family of cupro-nickel alloys is the Cu-Ni-Al alloy system containing 5 to 30% by weight Ni and 0.5 to 5% by weight Al, in which ranges $Ni_3Al$ forms within the alloy matrix. Another example from this particular alloy family is the Cu-Ni-Si system containing 0.5 to 15% by weight Ni and 0.5 to 3% by weight Si, in which the $Ni_3Si$ phase, which is analogous to the $Ni_3Al$ phase, presumably forms within the alloy matrix. A third example of the cupro-nickel alloy system may be found in the Cu-Ni-Sn system containing 3 to 30% by weight Ni and 2 to 15% by weight Sn in which a Ni-Sn rich solid soltuion precipitate forms spinodally and, therefore, continuously and coherently within the copper matrix of the alloy.

Nickel-aluminum containing copper alloys are well known in the prior art, such as disclosed in U.S. Pat. Nos. 2,101,087, 2,101,626 and 3,399,057. These patents do not contemplate the preparation of spinodal, precipitation hardened copper alloys having finely dispersed precipitates of $Ni_3Al$ particles as disclosed in the present invention.

Thermodynamic considerations and phase equilibrium relationships dictate whether a decomposition within an alloy matrix can proceed spinodally. Spinodal decomposition is defined as a diffusion controlled, homogeneous phase separation which takes place in a solid solution whose composition and temperature is within the coherent spinodal of a miscibility gap within the two phase region of the alloy. Thus, to complete the definition of spinodal decomposition, the coherent spinodal of a miscibility gap must also be defined.

A phase diagram for a binary system, in which two solid solutions of similar crystallographic structure are in equilibrium, indicates a solid-state miscibility gap when the alloy is cooled into the two phase field so that it decomposes into the two phases. Associated with the equilibrium miscibility gap is the coherent solvus or coherent miscibility gap below which the two phases can separate coherently into the two phases. This is analogous to the situation in any two phase region where there is a coherent solvus line associated with the equilibrium solvus. Below this coherent solvus, the precipitate or second phase of the alloy system will form coherently in the matrix. The second phase forms in alignment with the crystal structure of the matrix with little distortion at the precipitate/matrix interface. Associated with this coherent solvus line is the spinodal line, below which the reaction to provide coherent precipitates via spinodal decomposition will take place.

Accordingly, it is a principal object of the present invention to provide a method for the preparation of improved copper alloys having high strength and high strength to ductility ratio characteristics.

It is a further object of the present invention to provide a method for preparing an improved copper alloy as aforesaid which has other properties such as excellent formability characteristics in the precipitation hardened condition and resistance to mechanical property degradation at moderately elevated temperatures, such as stress relaxation resistance.

It is a still further object of the present invention to provide a method for preparing an improved copper alloy as aforesaid which is convenient and economical to prepare on a commercial scale.

Additional objects and advantages will become more apparent from a consideration of the following specification.

SUMMARY OF THE INVENTION

The objects and advantages presented above may be readily accomplished by the processing of the present invention. This processing includes a critical controlling of cooling of copper alloy systems exhibiting spinodal decomposition. This critical cooling is utilized after subjecting the alloy to a solutionizing temperature. In particular, the alloy, after being subjected to the solutionizing temperature, is cooled at a rate of less than 650° C per minute and particularly between approximately 0.5° C per minute and 650° C per minute.

DETAILED DESCRIPTION

The alloy systems which may be utilized in the processing of the present invention generally include any copper alloy systems which are capable of decomposition into an array of continuous, coherent precipitates in a solute depleted copper matrix. Such alloys include the Cu-Ti system containing between 0.5 and 4.7% by weight Ti, the Cu-Be system containing between 0.2 and 2.7% by weight Be and the coherent precipitation reactions that can be induced to form in various Cu-Ni systems through the addition of third and fourth alloying elements therein. These particular Cu-Ni systems can include the Cu-Ni-Al alloys containing between 5 and 30% by weight Ni and between 0.5 and 5% by weight Al. Alloying elements within these particular percentage ranges tend to form $Ni_3Al$ compounds within the overall alloy. The Cu-Ni systems also may include the Cu-Ni-Si system containing 0.5 to 15% by weight Ni and 0.5 to 3% by weight Si, which forms a $Ni_3Si$ phase which is analogous to the $Ni_3Al$ phase in the alloy system described above. Another example from the Cu-Ni systems includes the Cu-Ni-Sn system containing 3 to 30% by weight Ni and 2 to 15% by weight Sn in which a Ni-Sn rich solid solution precipitate forms spinodally and, therefore, continuously and coherently within the copper matrix of the alloy.

The various alloying elements combined with copper provide the precipitation hardening mechanism through the spinodal decomposition mode of the alloy systems utilized in the present invention from a solution treated and cooled or solution treated, cooled and cold worked alloy matrix. The critical cooling step of the present invention is a major factor in controlling the morphology of the precipitate. This control of the finely dispersed precipitate morphology in turn controls the strength to ductility ratio combination offered by the alloy systems utilized in the process of the present invention.

Other alloying ingredients may be included within the alloy systems utilized in the present invention in order to obtain particular combinations of properties within the alloy processing according to the present invention. A total of up to 20% by weight of one or more of the following materials may be included within the alloy systems utilized in the present invention. These materials include zirconium, hafnium, beryllium, vanadium, niobium tantalum, chromium, molybdenum, tungsten, zinc, iron and tin. The zinc, iron and tin components may be used in an amount ranging from 0.01 to 10% by weight for each component and are generally employed to provide additional solution strengthening, work hardening and precipitation hardening within the alloy since they partition equally or preferentially to the main alloy precipitate and to the alpha copper matrix, thereby making the matrix and precipitate harder by affecting the lattice parameters of the matrix and the precipitate so as to increase the interfacial coherency strains and so as to provide for enhanced precipitation hardening. In addition, the iron component is generally utilized also for restricting grain growth within the alloy.

The zirconium, hafnium and beryllium components may be employed in an amount from 0.01 to 5% each. These materials provide for a second precipitate particle in the alloy matrix by forming intermediate phases with copper and/or nickel. The vanadium, niobium, tantalum, chromium, molybdenum and tungsten components may also be employed in an amount from 0.01 to 5% each. These components are desirable since they provide for second precipitate particles in the alloy matrix in their own elemental form. Therefore, the zirconium, hafnium, beryllium, vanadium, niobium, tantalum, chromium and molybdenum or tungsten or mixtures of these may readily be utilized in the alloy system of the present invention in order to provide additional particle hardening, with the alloy matrix including second precipitate particles containing said materials, or to provide improved processing characteristics, such as providing for grain size control. Moreover, even small amounts of each of the foregoing elements are capable of influencing the reaction kinetics and morphology hardness of the base precipitation process.

In addition to the foregoing, a total of up to 5% of one or more of the following materials may be present in an amount from 0.001 to 3% each: Lead, arsenic, antimony, boron, phosphorus, manganese, silicon, a lanthanide metal, such as mischmetal or cerium, magnesium and/or lithium. These materials are useful in improving mechanical properties or corrosion resistance or processing. The alloy melt may be deoxidized with such additions as are traditionally used to deoxidize or desulphurize copper, such as manganese, lithium, silicon, boron, magnesium or mischmetal. In fact, even those elements listed above as solution or precipitation or dispersed additives may be used in small amounts to deoxidize the melt, such as zirconium, hafnium, chromium, molybdenum and excess aluminum.

Naturally, arsenic and antimony additions may be used to promote corrosion resistance. Moreover, compositions containing lead, sulfur and/or tellurium additions would provide the additional benefits of a highly machinable alloy, provided, however, that these alloys would not be readily hot workable.

The alloy of the present invention may be cast in any convenient manner such as direct chill or continuous casting. The alloy should be homogenized at temperatures between 600° C and the solidus temperature of the particular alloy for at least 15 minutes followed by hot working with a finishing temperature in excess of 400° C. For example, a representative alloy composition containing 15% nickel and 2% aluminum of the present invention has a solidus temperature of 1120° C. The homogenizing procedure may be combined with the hot working procedure, that is, the alloy may be heated to hot working starting temperature and held at said starting temperature for the requisite period of time. The hot working starting temperature should preferably be in the solid solution range appropriate to the particular composition.

Following hot working, the alloy may be cold worked at a temperature below 200° C with or without intermediate annealing depending upon particular gage requirements. In general, annealing may be performed using strip or batch processing with holding times of from 10 seconds to 24 hours at temperatures from 250° C to within 50° C of the solidus temperature for the particular alloy.

The alloy should then be given a solution treatment within the temperature range of 650° C to 1100° C, and generally above 800° C. This is a key step in the processing of the present invention since this step is required for the formation on cooling of the extremely finely dispersed particles by a spinodal decomposition mechanism. The solution annealing step should be carried out for from 10 seconds to 24 hours.

Following solution annealing, the alloy may be immediately hot worked and then cold worked to the desired working gage. The alloy may than be given a solution treatment within the temperature range of 650° C to 1100° C, generally kept above 800° C, in order to help form the finely dispersed particles brought about by the spinodal decomposition mechanism.

After being subjected to the solution treatment, the alloy is then allowed to cool to room temperature. In accordance with the present invention, it has been found that the cooling rate from the solution treatment temperature is critical in controlling the morphology of the precipitation product upon subsequent aging of the solution treated or solution treated and cold worked material. In particular, when the alloy is slowly cooled at a rate of less than 650° C per minute from the solution treatment temperature, a continuous precipitation of finely dispersed coherent particles results in the alloy matrix. The alloy should preferably be cooled at a rate between approximately 0.5° C/minute and 650° C/minute to result in improved stress relaxation properties for the alloy following cold working and aging. When the alloys utilized in the present invention are cooled at rates within this range, they exhibit the continuous precipitation mode in the as-cooled condition and retain said mode throughout subsequent cold working and aging. In addition, the use of carefully controlled cooling in the process of the present invention is not only amenable to current commercial plant practice but it should be more economical and convenient than the steps required to obtain a rapid quenching.

Thus, following solution annealing one may cool the material using a slow cooling mechanism or quenching mechanism as indicated hereinabove. In addition, one may age the solution treated material at a temperature of from 250° C to 650° C for times of from 30 minutes to 24 hours. The final condition of the material may be either solution treated, solution treated and aged, or solution treated, cold worked and aged.

Alternatively, one may provide additional cold working after the aging treatment. This additional cold working results in additional strength but loss in formability and ductility.

For applications where maximum ductility is desired the alloy should be quenched after the solution anneal. Subsequent cold working and aging generates both higher strength and better ductility than the as-cold worked metal. This improvement in both of these properties with aging is quite remarkable.

If maximum strength is desired rather than maximum ductility, the alloys should be slowly cooled from the solution anneal. Subsequent processing of this condition, including cold working and aging, results in increased strength with only slight loss in formability. It is quite surprising that material slowly cooled from solution annealing in this manner exhibits an aging response. Thus, the alloys of the present invention may be processed to obtain a variety of properties related to control of the cooling rate following the solution anneal at a temperature of from 650° C to 1100° C. The aging step at temperatures of from 250° C to 650° C for times of from 30 minutes to 24 hours results in improved property combinations. The alloys may optionally be cold worked, for example, up to 90%, between the solution anneal and the aging steps, if desired, with the particular variations and the degree of working depending upon the final property requirements.

Parts may be formed from cold worked and/or aged material, with an optional heat treatment after forming. The heat treatment may be an aging treatment as above, or a low temperature thermal treatment at 150° - 300° C for at least 15 minutes to enhance stress relaxation or stress corrosion resistance.

The present invention and improvements resulting therefrom will be more readily understandable from a consideration of the following illustrative example.

EXAMPLE I

An alloy consisting of 15% by weight nickel and 2% by weight aluminum, balance copper was cast from 350° C into a steel mold with a water-cooled copper base plate. The 10 pound ingot resulting from the casting process was heated at 1000° C for 4 hours, immediately hot worked to 0.4 inches from 1.75 inches and cold worked to 0.12 inches. The alloy was then solution treated at 900° C for ½ hour, after which part of the metal was then water quenched and the other part was allowed to slowly cool to room temperature in a wrapping of ceramic cloth. The solution treatment yielded a grain size of about 55 μm. Both sections of the alloy were cold worked 75% to 0.03 inches. A portion of each of the cold worked specimens was then heat treated or aged at 400° C for 2 hours. Tensile properties and the stress relaxation resistance were determined for both the as-cold worked and the heat treated materials. The tensile properties are listed in Table I while the stress relaxation behavior of the alloy in each of the four conditions which were tensile tested is listed in Table II.

TABLE I

TENSILE PROPERTIES OF Cu-15Ni-2Al

| Condition | 0.2% Yield Strength (ksi) | Ultimate Tensile Strength (ksi) | Elongation (%) |
|---|---|---|---|
| Water Quenched From The Solution Treatment* | | | |
| CR 75% | 95 | 100 | 1.6 |
| CR 75% + Aged** | 106 | 126 | 11.8 |
| Slowly Cooled From The Solution Treatment* | | | |
| CR 75% | 126 | 140 | 1.0 |
| CR 75% + Aged** | 129 | 147 | 6.5 |

*Solution Treated At 900° C-½Hour
**Aging Treatment At 400° C-2 Hours

TABLE II

STRESS RELAXATION PROPERTIES OF Cu-15Ni-2Al MEASURED AT 105° C WITH A CANTILEVER TEST APPARATUS

| Condition | 0.2% Yield Strength (ksi) | Initial Applied Stress | | Stress Remaining After 1,000 Hours | | Extrapolated Stress Remaining After 1,000,000 Hours | |
|---|---|---|---|---|---|---|---|
| | | ksi | % of 0.2% YS | ksi | % of Initial | ksi | % of Initial |
| Water Quenched From The Solution Treatment* | | | | | | | |
| CR 75% | 95 | 73.8 | 77.7 | 58.6 | 79.4 | 53.6 | 72.6 |
| CR 75% + Aged** | 106 | 82.5 | 77.8 | 62.2 | 75.4 | 54.5 | 66.1 |
| Slowly Cooled From The Solution Treatment* | | | | | | | |
| CR 75% | 126 | 98.7 | 78.3 | 72.3 | 73.3 | 65.4 | 66.3 |

TABLE II-continued

STRESS RELAXATION PROPERTIES OF Cu-15Ni-2Al MEASURED AT 105° C WITH A CANTILEVER TEST APPARATUS

| Condition | 0.2% Yield Strength (ksi) | Initial Applied Stress | | Stress Remaining After 1,000 Hours | | Extrapolated Stress Remaining After 1,000,000 Hours | |
|---|---|---|---|---|---|---|---|
| | | ksi | % of 0.2% YS | ksi | % of Initial | ksi | % of Initial |
| CR 75% + Aged** | 129 | 99.5 | 77.1 | 90.6 | 91.1 | 87.0 | 87.4 |

*Solution Treated At 900° C-½ Hour
**Aging Treatment At 400° C-2 Hours

Table I shows the increase in strength upon aging of both of the cold worked alloy strips. The aging mechanism responsible for the increase in strength of the metal cold worked from the water quench is primarily that of discontinuous precipitation. The aging mechanism responsible for the increase in strength of the metal cold worked from the slowly cooled condition is primarily that of continuous precipitation of fine, spherical coherent $Ni_3Al$ particles which appear during the cooling process and remain relatively stable during the subsequent cold working and aging of the alloy.

The stress relaxation data presented in Table II were determined with cantilever specimens with the bending moment applied about an axis normal to the working or rolling direction and in the plane of the strip. The initial applied stresses in the outer fiber at the outer curvature were set at values equivalent to about 80% of the 0.2% offset yield strength. The stressed specimens were placed within a 105° C oven throughout the duration of the test, but every specimen was withdrawn periodically for a measurement at room temperature of the amount of load drop experienced over the particular length of exposure time. This load drop can be directly related to the stress drop which is the amount of stress relaxation. The higher the stress remaining (actual or percentage), the more suitable is the material for service as an electrical connector. The data presented in Table II clearly show that the metal that had been solution treated, slowly cooled, cold worked and aged had better stress relaxation resistance than the metal that had been solution treated, water quenched, cold worked and aged.

Therefore, such data as presented in Tables I and II clearly demonstrate the superiority of slowly cooled material when compared to the properties of the same material as rapidly cooled during similar processing. The processing of the present invention is clearly superior to normal rapid quenching for providing desirable high mechanical strength and high resistance to stress relaxation in alloys formed by such a process.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A method for obtaining precipitation hardened copper base alloys via continuous, coherent precipitation such as spinodal decomposition having high strength and favorable strength to ductility characteristics which comprises:

a. providing a copper base alloy selected from the group consisting of those Cu-Ti alloys, Cu-Be alloys and Cu-Ni base alloys which exhibit continuous, homogeneous precipitation of coherent particles upon precipitation hardening;

b. hot working said alloy with a finishing temperature in excess of 400° C;

c. solution annealing said alloy for from 10 seconds to 24 hours at a temperature of from 650° to 1100° C; and d. cooling the alloy to room temperature at a rate of less than 650° C per minute to provide a spinodal, precipitation hardened copper base alloy wherein the microstructure is characterized by the presence of finely dispersed precipitates of alloying element-rich particles dispersed throughout the copper alloy matrix.

2. A method according to claim 1 wherein said alloy includes a total of up to 20% of a material selected from the group consisting of from 0.01 to 10% zinc, from 0.01 to 10% iron, from 0.01 to 10% tin, from 0.01 to 5% each of zirconium, beryllium, vanadium, niobium, tantalum, chromium, molybdenum, tungsten and mixtures thereof, and wherein the resultant microstructure is characterized by the presence of second precipitate particles.

3. A method according to claim 1 wherein said alloy includes a total of up to 5% of a material selected from the group consisting of lead, arsenic, antimony, boron, phosphorus, manganese, silicon, a lanthanide metal, magnesium, lithium and mixtures thereof, with each of said materials being present in an amount from 0.001 to 3%.

4. A method according to claim 1 wherein said alloy is homogenized prior to hot working at a temperature between 600° C and the solidus temperature of the alloy for at least 15 minutes.

5. A method according to claim 1 wherein said alloy is cold worked following hot working but before solution annealing.

6. A method according to claim 5 wherein all working steps are rolling.

7. A method according to claim 6 wherein said alloy is cold rolled with intermediate annealing at from 250° C to within 50° C of the solidus temperature for from 10 seconds to 24 hours.

8. A method according to claim 1 wherein said alloy is cooled at a rate between 0.5° C per minute and 650° C per minute.

9. A method according to claim 8 wherein the alloy is aged following cooling at a temperature of from 250° to 650° C for from 30 minutes to 24 hours.

10. A method according to claim 9 wherein the alloy is cold rolled and aged following cooling.

11. A method according to claim 1 wherein said alloy is a Cu-Ti alloy consisting essentially of 0.5 to 4.7% by weight Ti, balance Cu.

12. A method according to claim 1 wherein said alloy is a Cu-Be alloy consisting essentially of 0.2 to 2.7% by weight Be, balance Cu.

13. A method according to claim 1 wherein said alloy is a Cu-Ni-Al alloy consisting essentially of 5 to 30% by weight Ni, 0.5 to 5% by weight Al, balance Cu.

14. A method according to claim 1 wherein said alloy is a Cu-Ni-Si alloy consisting essentially of 0.5 to 15% by weight Ni, 0.5 to 3% by weight Si, balance Cu.

15. A method according to claim 1 wherein said alloy is a Cu-Ni-Sn alloy consisting essentially of 3 to 30% by weight Ni, 2 to 15% by weight Sn, balance Cu.

16. A method according to claim 7 wherein said alloy is cold rolled at a temperature below 200° C.

17. A method according to claim 1 wherein said solution annealing is at a temperature of from 800° to 1100° C.

18. A method according to claim 9 wherein said alloy is formed into parts and subjected to a low temperature thermal treatment at 150° to 300° C for at least 15 minutes.

* * * * *